US012649967B2

(12) United States Patent
Cona et al.

(10) Patent No.: US 12,649,967 B2
(45) Date of Patent: Jun. 9, 2026

(54) STABILIZATION APPARATUS FOR MODERATING VIBRATIONS AND OSCILLATIONS OF A METAL STRIP IN MOTION

(71) Applicant: DANIELI & C. OFFICINE MECCANICHE S.p.A., Buttrio (IT)

(72) Inventors: Alessandro Cona, Tolmezzo (IT); Luciano Vignolo, Udine (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 545 days.

(21) Appl. No.: 17/757,062

(22) PCT Filed: Dec. 10, 2020

(86) PCT No.: PCT/IB2020/061738

§ 371 (c)(1),
(2) Date: Jun. 8, 2022

(87) PCT Pub. No.: WO2021/116964

PCT Pub. Date: Jun. 17, 2021

(65) Prior Publication Data

US 2022/0372607 A1 Nov. 24, 2022

(30) Foreign Application Priority Data

Dec. 10, 2019 (IT) ..... 102019000023484

(51) Int. Cl.
*C23C 2/16* (2006.01)
*C23C 2/00* (2006.01)
(Continued)

(52) U.S. Cl.
CPC ..... *C23C 2/20* (2013.01); *C23C 2/0035* (2022.08); *C23C 2/16* (2013.01); *C23C 2/24* (2013.01)

(58) Field of Classification Search
CPC .... C23C 2/00; C23C 2/40; C23C 2/06; C23C 2/20
(Continued)

(56) References Cited

U.S. PATENT DOCUMENTS 3,499,418 A * 3/1970 Mayhew ..... C23C 2/20 427/349
4,237,815 A * 12/1980 Ernest ..... C23C 2/20 118/63
(Continued)

FOREIGN PATENT DOCUMENTS

DE 102006052000 A1 5/2008
DE 102009051932 A1 5/2011
(Continued)

OTHER PUBLICATIONS

Patent Cooperation Treaty, International Search Report and Written Opinion for International Application No. PCT/IB2020/061738, Mar. 10, 2021, 16 pages.

*Primary Examiner* — Karl Kurple
(74) *Attorney, Agent, or Firm* — Stetina Garred Brucker & Newboles

(57) ABSTRACT

A stabilization apparatus for stabilizing a metal strip rising from a molten metal bath along a theoretical feeding plane comprises at least one pair of air knives, each being arranged in a mutually specular manner with respect to said plane. The apparatus further includes at least one pair of electromagnetic stabilizing devices, each being arranged in a mutually specular manner with respect to said plane. A pair of first support beams are included, each supporting a respective air knife, and a pair of second support beams are also included, each supporting a respective electromagnetic stabilizer device. The pair of second support beams is distinct from the pair of first support beams, and the first support beams are distal from the plane, while the second
(Continued)

support beams are proximal to the plane and arranged in an innermost position with respect to the pair of first support beams.

19 Claims, 5 Drawing Sheets

(51) Int. Cl.
*C23C 2/20* (2006.01)
*C23C 2/24* (2006.01)

(58) Field of Classification Search
USPC ..... 118/63
See application file for complete search history.

(56) References Cited

U.S. PATENT DOCUMENTS 4,321,884 A * 3/1982 Barkley ..... B05C 11/06 427/349
4,347,805 A * 9/1982 Ernest ..... B05C 11/10 118/63
4,619,835 A * 10/1986 Francois ..... C23C 2/265 118/712
4,655,166 A * 4/1987 Nishimura ..... C21D 9/56 118/63
5,074,242 A * 12/1991 Bricmont ..... B05C 11/06 118/63
5,384,166 A * 1/1995 Sato ..... F16F 15/03 427/349
5,401,317 A * 3/1995 Cox ..... B05C 3/125 118/712
5,423,913 A * 6/1995 Fontaine ..... C23C 2/20 118/63
5,614,266 A * 3/1997 Cox ..... B05C 3/125 427/349
5,683,514 A * 11/1997 Cox ..... B05C 3/125 118/712
5,786,036 A * 7/1998 Pannenbecker ..... C23C 2/20 118/712
6,471,153 B1 * 10/2002 Kimura ..... B21C 47/34 226/93
8,616,148 B2 * 12/2013 Fujioka ..... C23C 2/20 118/62
9,080,232 B2 * 7/2015 Ohara ..... C23C 2/20
9,371,884 B2 * 6/2016 Ohara ..... C23C 2/40
10,876,194 B2 * 12/2020 Ishigaki ..... C23C 2/00344
10,907,242 B2 * 2/2021 Fontaine ..... C23C 2/00344
12,018,379 B2 * 6/2024 Fontaine ..... C23C 2/0035
12,163,230 B2 * 12/2024 Fontaine ..... C23C 2/003
2010/0282161 A1 * 11/2010 Fujioka ..... C23C 2/20 118/62
2017/0283929 A1 * 10/2017 Fontaine ..... C23C 2/20
2018/0363116 A1 12/2018 Fontaine
2022/0267885 A1 * 8/2022 Pearcey ..... C23C 2/00344
2023/0193444 A1 * 6/2023 Cloutot ..... C23C 2/14 118/708

FOREIGN PATENT DOCUMENTS

EP 1784520 A1 5/2007
EP 1918410 A2 5/2008
JP 2001131724 A * 5/2001 ..... C23C 2/00
JP 2010180435 A * 8/2010 ..... C23C 2/003
JP 2012102389 A * 5/2012
WO 2012172648 A1 12/2012

* cited by examiner

STABILIZATION APPARATUS FOR MODERATING VIBRATIONS AND OSCILLATIONS OF A METAL STRIP IN MOTION

CROSS-REFERENCE TO RELATED APPLICATIONS

This application claims priority to PCT International Application No. PCT/IB2020/061738 filed on Dec. 10, 2020, which application claims priority to Italian Patent Application No. 102019000023484 filed on Dec. 10, 2019, the disclosures of which are expressly incorporated herein by reference.

STATEMENT RE: FEDERALLY SPONSORED RESEARCH/DEVELOPMENT

Not Applicable

BACKGROUND

Field of the Invention

The present invention relates to the field of plants for coating flat products of ferromagnetic material, e.g. metal strips, in particular steel strips. More in detail, the invention relates to a stabilization apparatus for moderating vibrations and oscillations of a strip made of ferromagnetic material in motion and correcting the deformation thereof during a coating process with molten metal, e.g. a galvanizing process. The present invention further relates to a plant for coating a metal strip with molten metal comprising said stabilization apparatus.

Prior Art

As known, strips made of ferromagnetic material are externally coated by means of a plurality of coating processes, e.g. by galvanizing.

The air knife zone above the tank containing the molten metal, e.g. zinc, is the heart of the coating process and influences plant availability, process productivity, product quality and zinc consumption.

In such coating processes, the moving metal strip is normally subject to deformations and vibrations, corrected by using electromagnetic stabilizer devices to improve process productivity and optimize zinc consumption.

Indeed, such electromagnetic stabilizer devices make it possible to reduce the amplitude of the strip vibration in the air knife zone and, at the same time, to improve the shape of the strip by reducing the amplitude of the static shape defects, such as crossbows.

For example, FIGS. 1 and 2 schematically illustrate a stabilizer apparatus in which the electromagnetic stabilizer devices 2 are mounted on the same support beam 3 which supports the corresponding and underlying air knife 1. This configuration has the advantage of allowing a short distance between the impact zone of the air jets on the strip and the strip stabilization zone, and consequently good effectiveness in controlling both the vibrations and the shape of the strip downstream of the air knives 1.

However, this configuration has several drawbacks:

- the support beam is large because it must support both the weight of the air knife and the weight of the electromagnetic stabilizer device;

- the configuration is complex and thus has a significant impact on the investment cost;
- the procedure for removing the air knife for a maintenance thereof is complicated;
- in case of modernization of a plant with only air knives, by adding the stabilizer, it is essential to intervene also on the air knives and their movement system.

The need is thus felt to solve the aforesaid drawbacks by implementing an innovative configuration of the stabilization apparatus.

SUMMARY OF THE INVENTION

It is an object of the present invention to make a stabilization apparatus for stabilizing a metal strip rising from a molten metal bath, the apparatus being extremely simple and compact.

It is a further object of the present invention to make a stabilization apparatus having such a structure as to improve the performance of the air knives with regard to the accuracy of the coating thickness on the strip.

It is a further object of the present invention to make a stabilization apparatus having a low investment cost impact.

It is a further object of the present invention to make a stabilization apparatus that facilitates maintenance operations both on the air knives and the electromagnetic devices, minimizing the number of lifting operations and eliminating the need to disassemble the stabilization device from the old air knives to reassemble it on the new set of air knives.

The present invention achieves at least one of such objects, and other objects which will be apparent in light of the present description, by means of a stabilization apparatus for stabilizing a metal strip rising from a molten metal bath along a theoretical feeding plane X, the apparatus comprising

- at least one pair of air knives, a first air knife being arranged at a first side and a second air knife being arranged at a second side, opposite to the first side, with respect to said theoretical feeding plane X;
- at least one pair of electromagnetic stabilizer devices, a first electromagnetic stabilizer device being arranged at said first side and a second electromagnetic stabilizer device being arranged at said second side;
- a pair of first support beams, each first support beam supporting a respective air knife;
- a pair of second support beams, each second support beam supporting a respective electromagnetic stabilizer device;
- wherein the pair of second support beams is distinct from the pair of first support beams, and wherein the first support beams are distal from the theoretical feeding plane X, while the second support beams are proximal to said theoretical feeding plane X and arranged in a position which is at least partially inner to the pair of first support beams.

Another aspect of the invention relates to a plant for coating a metal strip with a layer of molten metal comprising the aforesaid stabilization apparatus placed above a tank adapted to contain the molten metal bath.

Advantageously, both the two support beams of the electromagnetic stabilizers and the two support beams of the air knives are mounted disjointly on two side structures, which are transversal to said four support beams and allow, before starting the operating phase, the lifting or lowering both of the air knives and the electromagnetic stabilizer devices. This makes it possible to obtain the integral movement of the electromagnetic stabilizer devices and the air knives relative to the process parameters of the line (strip speed and coating thickness) and the possible corrections of parallelism with respect to the strip position.

At the same time, in a step of maintenance, this disjointed assembly allows the support beams of the electromagnetic stabilizers and the support beams of the air knives to be lifted separately, e.g. by means of a crane.

Maintenance is performed in the following sequence:

disassembly and lifting, from the two side structures, firstly of the support beams of the electromagnetic stabilizer devices and then of the support beams of the air knives;

reassembly firstly of the support beams of the air knives and then reassembly of the support beams of the electromagnetic stabilizer devices.

Furthermore, the configuration of the apparatus of the invention makes it possible to avoid that the stresses, produced as a reaction to the forces generated by the electromagnetic devices, are discharged onto the air knife support beams, with an obvious negative influence on the performance of the air knives as regards the coating thickness accuracy. Indeed, the stresses generated by the electromagnetic devices are discharged on their respective support beams, disjointed from the support beams of the air knives.

The support beams of the electromagnetic devices are, in turn, constrained at their ends to said two side structures which guarantee a high rigidity thereof.

Moreover, in order to further increase the rigidity of the support beams of the electromagnetic devices, a connection system between these beams can be provided, on both operator side and motor side, to create a sort of frame which increases the flexural rigidity of the stabilization group and, preferably, also of the baffle system of the air jets.

A further advantage is represented by the variant in which, in order to increase the compactness of the apparatus of the invention, the air knife baffle system at the edges of the strip can be supported by the same second support beam of one or more electromagnetic stabilizer devices, and thus the assembly of the baffle system can be integrated with that of at least one electromagnetic stabilizer device.

In particular, one of the second support beams also supports the air knife baffle system comprising two edge baffles, one for each edge of the strip.

Preferably, the second support beams are suitably shaped to allow a horizontal movement of the electromagnetic stabilizer devices from a working position, proximal to the strip feeding plane, to a resting position, distal from said strip feeding plane, while maintaining the compactness of the apparatus.

A further advantage is represented by the variant in which the air knife support beams are appropriately shaped to minimize as much as possible the distance between the air jet impact zone, for controlling the coating, and the electromagnetic stabilizers.

In particular, the air knife support beams can be shaped so that their central stretch, at the position of the advancing strip, is placed at a distance from the feeding plane such as to allow the housing of the stabilizer in the zone between these two central stretches. In this manner, the housings which contain the electromagnetic actuators can be lowered as close as possible with respect to the air knife nozzles. This is done to maximize the control effect on both the vibrations and the shape of the strip by means of the electromagnetic stabilizers.

Further features and advantages of the invention will become more apparent in light of the detailed description of preferred, but not exclusive embodiments.

The dependent claims describe particular embodiments of the invention.

BRIEF DESCRIPTION OF THE FIGURES

The description of the invention refers to the accompanying drawings, which are provided by way of non-limiting example, in which.

The same reference numbers and letters in the figures refer to the same elements or components.

DESCRIPTION OF EXAMPLE EMBODIMENTS OF THE INVENTION

Figure 3:
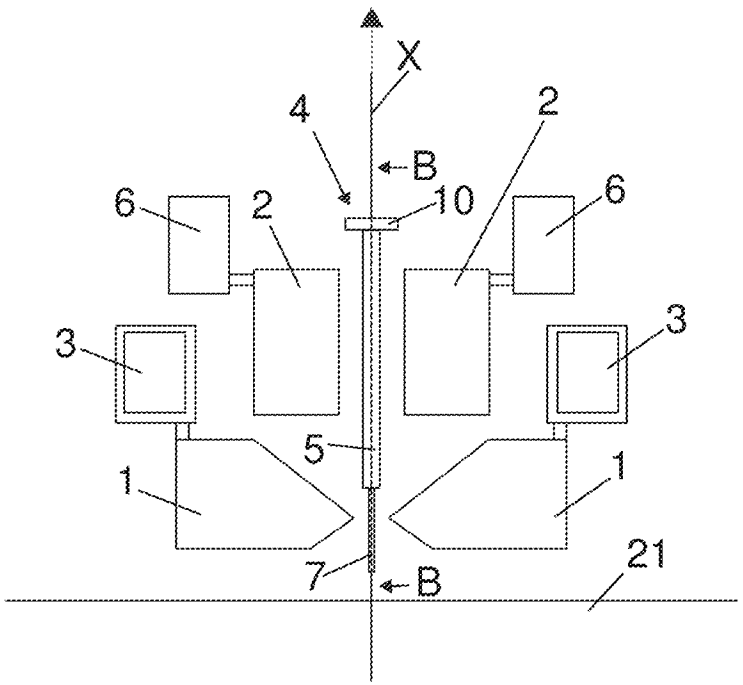
FIG. 3 is a diagrammatic view of a stabilization apparatus according to the invention.
Figure 1:
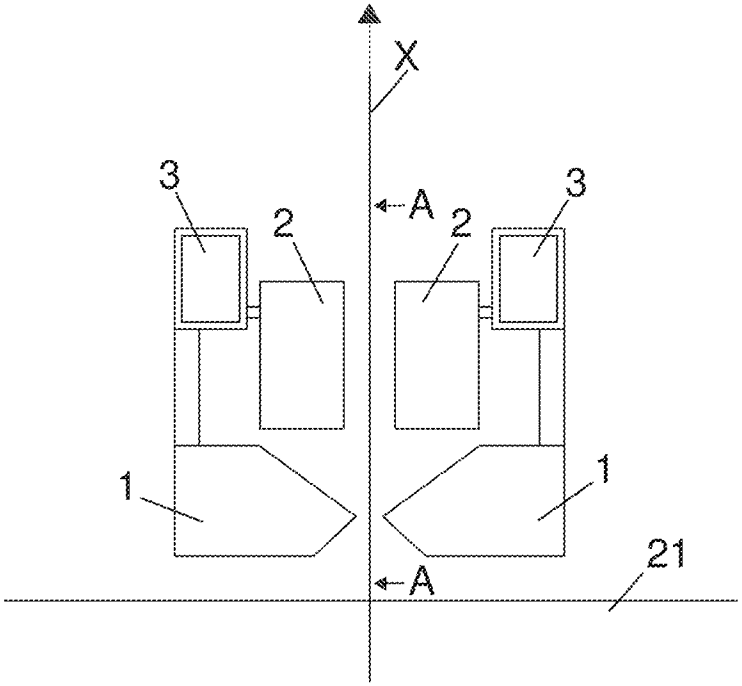
Fig. 1 PRIOR ART
FIG. 1 is a diagrammatic view of a stabilization apparatus of the prior art.
Figure 2:
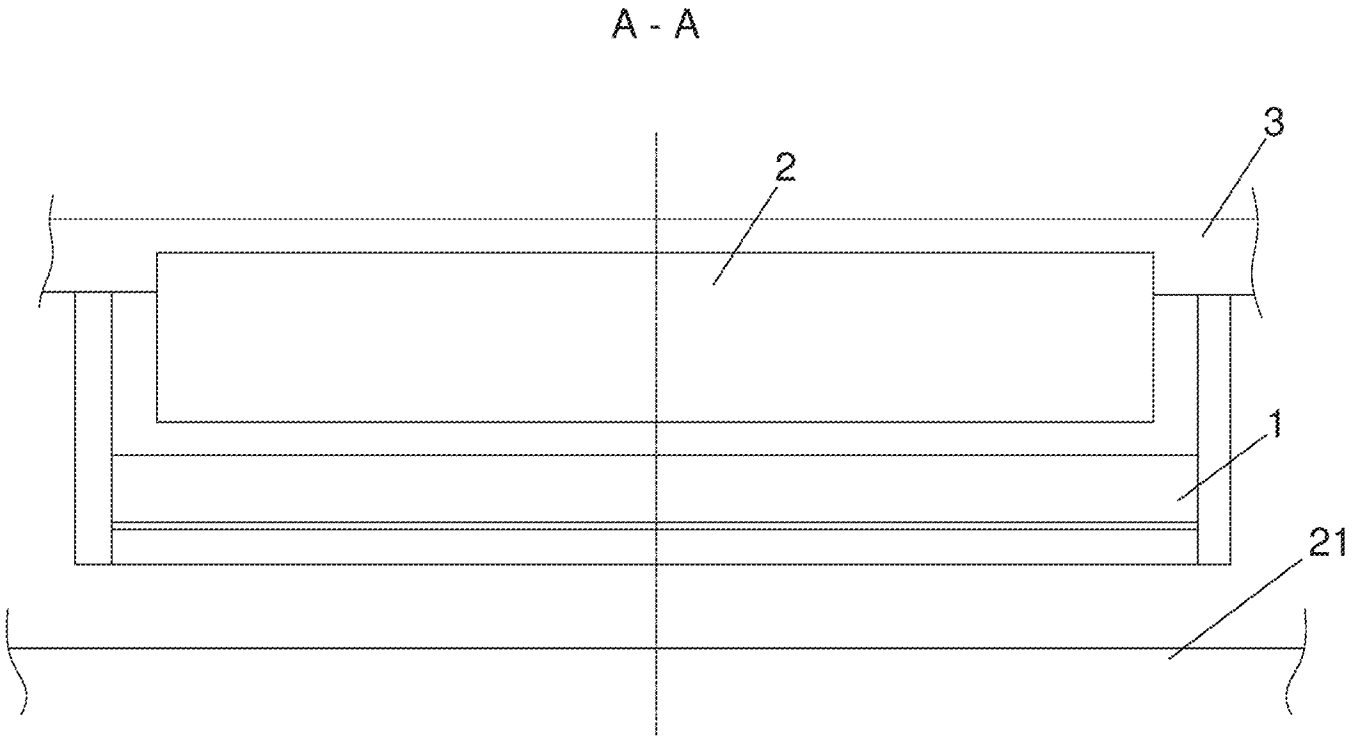
Fig. 2 PRIOR ART
FIG. 2 is a side view taken along plane A-A of the apparatus in FIG. 1.

Some examples of a stabilization apparatus according to the invention, adapted to stabilize a metal strip rising from a molten metal bath 21, e.g. zinc, along a theoretical feeding plane X, are illustrated with reference to the figures.

In all embodiments of the invention, the stabilization apparatus comprises:

at least one pair of air knives 1, preferably only one pair, a first air knife of which is arranged at a first side of the theoretical feeding plane X and a second air knife is arranged at a second side, opposite to the first side, of said theoretical feeding plane X;

at least one pair of electromagnetic stabilizer devices 2, preferably only one pair, a first electromagnetic stabilizer device of which is arranged at said first side and a second electromagnetic stabilizer device is arranged at said second side;

a pair of first support beams 3, each first support beam 3 supporting a respective air knife 1;

a pair of second support beams 6, each second support beam 6 supporting a respective electromagnetic stabilizer device 2.

Preferably, in the operation step of the apparatus, each air knife 1 is arranged in a mirror image of the other with respect to the theoretical feeding plane X, i.e. the air knives 1 are arranged symmetrically with respect to the theoretical feeding plane X. Similarly, each electromagnetic stabilizer device 2 is arranged in a mirror image of the other with respect to said theoretical feeding plane X, i.e. the electromagnetic stabilizer devices are arranged symmetrically with respect to said theoretical feeding plane X.

Advantageously, the pair of second support beams 6 is distinct, i.e. separate, from the pair of first support beams 3, the first support beams 3 are distal from the theoretical feeding plane X, and the second support beams 6 are proximal to said theoretical feeding plane X. The fact that the first and second support beams are mutually distinct or separate means that the second support beams 6 are not supported either directly or indirectly by the corresponding first support beams 3. In particular, the second support beams 6 are not resting on the first support beams 3 nor are supported in any manner by the first support beams 3. This makes it possible to avoid that the stresses, produced as a reaction to the forces generated by the electromagnetic stabilizer devices 2, are discharged onto the support beams 3 of the air knives 1, with an obvious negative influence on the performance thereof with regard to the coating thickness accuracy. Indeed, the stresses generated by the electromagnetic stabilizer devices 2 are discharged on own respective support beams 6, that are separated from the support beams of the air knives 1.

Furthermore, the second support beams 6 can be arranged, with reference to the theoretical feeding plane X, in an at least partially innermost position, or in a completely innermost position, with respect to the pair of first support beams 3. This arrangement of the support beams makes the apparatus of the invention simpler and more compact than known solutions.

In particular, the second support beams 6 can be arranged parallel to the first support beams 3.

Figure 6:
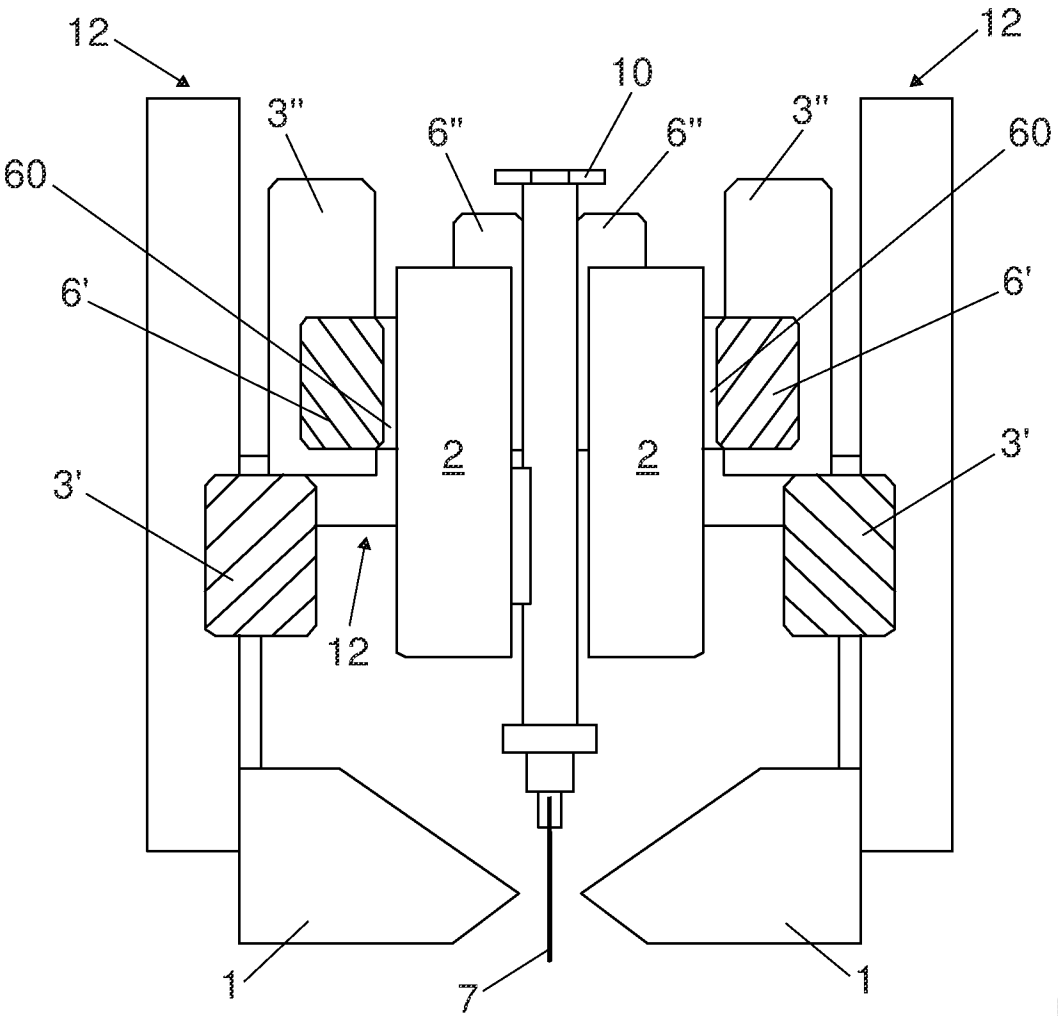
FIG. 6 is a section view of an embodiment of the stabilization apparatus according to the invention.

Referring, for example, to FIG. 6, the second support beams 6 can be arranged, only in at least a portion thereof, above the first support beams 3.

In particular, the two first support beams 3 are distinct from each other and respectively arranged at said first side and said second side of said theoretical feeding plane X, preferably in a mutually specular manner, i.e., the support beams 3 are positioned symmetrically with respect to said theoretical feeding plane X; and the two second support beams 6 are also distinct from each other and arranged respectively at said first side and said second side, preferably in a mutually specular manner with respect to said theoretical feeding plane X, i.e. the support beams 6 are positioned symmetrically with respect to the theoretical feeding plane X.

In order to further increase the compactness of the apparatus of the invention, a variant provides that the baffle system 4 of the air jets, coming from said air knives 1, is arranged between the second support beams 6, is fixed to at least one, preferably only one, of said second support beams 6 and comprises at least one pair of baffles 7, each baffle 7 being placed between the air knives 1 at a respective end of the air knives. The baffles 7 have the function of reducing the noise generated by the interference of the air jets and minimizing the over-coating of the strip edges, especially for low speed strips with heavy coatings.

A particular embodiment of said baffle system 4 comprises two supports 5, each support 5 being arranged at a respective side of a plane Y perpendicular to the theoretical feeding plane X.

The two supports 5 are substantially flat and arranged along the theoretical feeding plane X, preferably in a mutually specular manner, i.e. symmetrically, with respect to plane Y.

Figure 4:
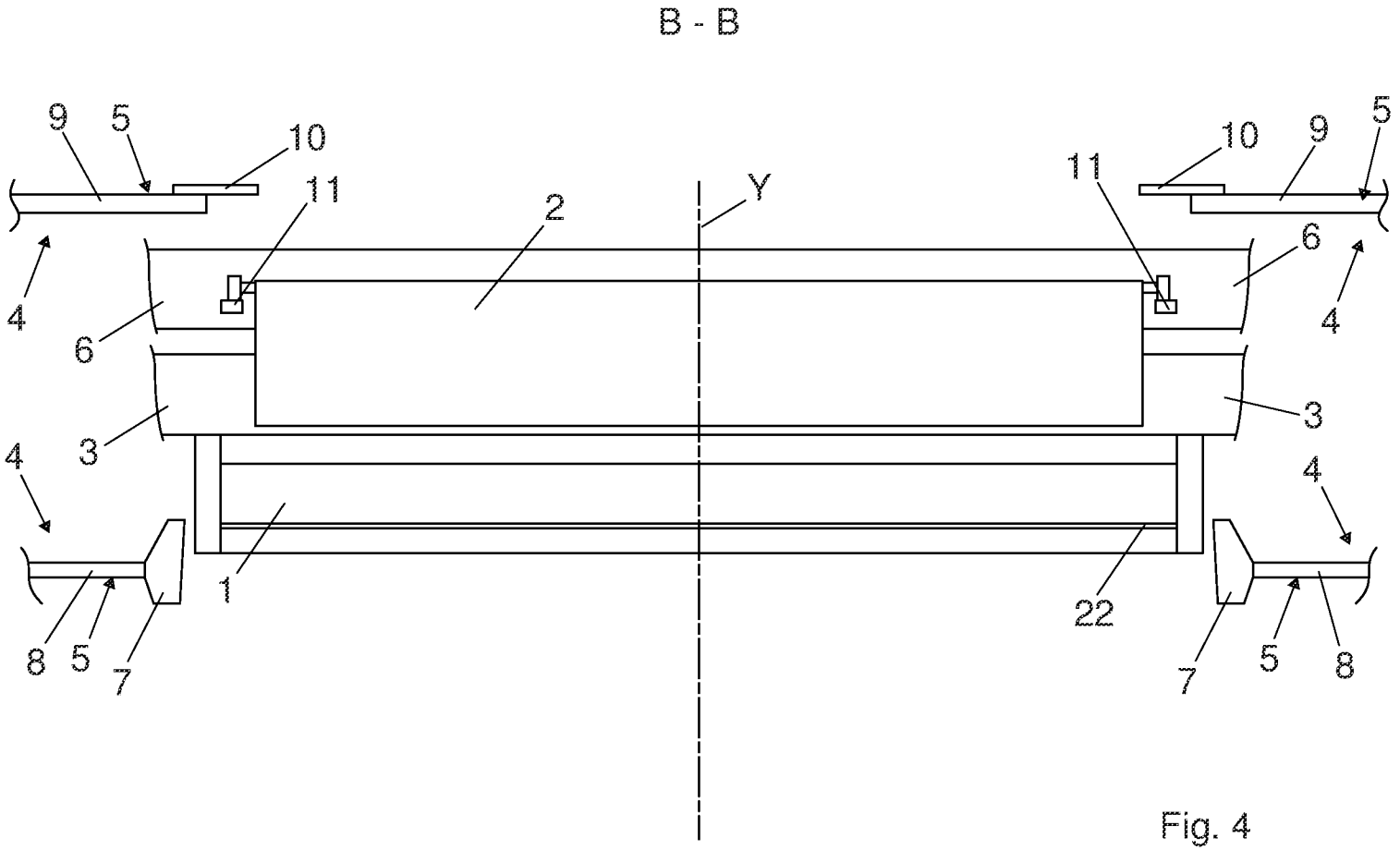
FIG. 4 is a side view taken along plane B-B of the apparatus in FIG. 3.

Each support 5, preferably C-shaped, has a lower arm 8, provided with a respective baffle 7, and an upper arm 9 provided with a detection device 10 for detecting an edge of the strip (FIG. 4). Such a detection device 10 can be, for example, a sensor of the photocell or camera type. The distance of the baffles 7 with respect to plane Y can be adjusted on the basis of the detection of the position of the edges of the strip rising from the molten metal bath. The distance between the two baffles 7 is, for example, between 500 and 2000 mm.

For example, the two supports 5 can be slidable, parallel to the theoretical feeding plane X, along one of the second support beams 6. The positioning of each baffle 7 can be performed by a linear servo actuator responding to the signal coming from the strip edge detection device 10. An absolute encoder can be included in the servo actuator.

During normal operation, there is no contact between the strip and the baffles. The detection device 10 can be kept clean for several weeks by an air curtain without operator intervention. The baffle 7 can automatically retract upon arrival of the weld seams on the strip as said strip rises from the bath.

A vertical adjustment mechanism can also be included for adjusting the height of the baffle during operation, e.g. ±20 mm from its initial reference position, thus a maximum adjustment of 40 mm.

A variation of the apparatus of the invention provides that both the first support beams 3 and the second support beams 6 have (FIG. 5):

- a first end 3", 6" resting on a first side structure 12;
- a second end 3", 6" resting on a second side structure 13, the side structures 12, 13 preferably being parallel to each other and to said plane Y.

Specifically, the first end 3" of each first support beam 3 rests on the first side structure 12 disjointly, or independently, from the first end 6" of each second support beam 6; and the second end 3'" of each first support beam 3 rests on the second lateral structure 13 in a disjoint, or independent, way from the second end 6'" of each second support beam 6.

Preferably, the first side structure 12 and the second side structure 13 have respective vertical movement means 100, optionally mutually synchronized, to either lift or lower the first supporting beams 3 and the second supporting beams 6 together. Such vertical movement means 100 comprise, for example, hydraulic, pneumatic or mechanical actuators.

For example, the vertical movement can be powered by a 2.2 kW AC gear motor through a mechanical jack.

Such a vertical movement can be between 70 mm and 700 mm from the nominal level of the molten metal in the tank below. The vertical movement speed is, for example, about 380-420 mm/min.

Advantageously, the first support beams 3 have a respective central stretch 3' supporting at the bottom the respective air knife 1, said central stretch 3' being outermost, with reference to the theoretical feeding plane X, and lowered with respect to the corresponding first ends 3" and second ends 3'" of the first support beams 3 (FIG. 6). Also the second support beams 6 have a respective central stretch 6' which is outermost, with reference to the theoretical feeding plane X, and preferably lowered with respect to the corresponding first ends 6" and second ends 6'" of the second support beams 6. Each central stretch 6', from the proximal side thereof to the theoretical feeding plane X, delimits a recess of the corresponding second support beam 6. The central stretches 3' of the first support beams 3 are advantageously arranged at a distance from the theoretical feeding plane X so as to allow the accommodation of the electromagnetic stabilizer devices 2 in the zone between said two central stretches 3'.

Preferably the intermediate beam stretches joining the first ends 3", or the second ends 3'", with the central stretch 3' are at least partially curvilinear, preferably defining an axis which has two inflection points, or can be intermediate beam stretches perpendicular to both the ends and the central stretch of the respective first support beam 3.

Instead, the intermediate beam stretches joining the first ends 6", or the second ends 6'", with the central stretch 6', in addition to that just described for the intermediate beam stretches of the first support beams 3, can have further portions 60 that are transverse, preferably orthogonal, to the central stretches 6' and defining, together with said central stretches 6', the recesses in which the electromagnetic stabilizing devices 2 are positioned.

Each electromagnetic stabilizer device 2 is preferably arranged, at least partially, within the recess of the respective second support beam 6. Optionally, sliding guides 11 (FIG. 5) are provided in said recess, preferably at the ends of said recess, for the sliding of the corresponding electromagnetic stabilizer device 2, along a direction perpendicular to the theoretical feeding plane X, from a working position to a resting position, or vice versa.

In the working position, proximal to the feeding plane X of the strip, the electromagnetic stabilizer device 2 is, for example, at a distance of 40 to 60 mm from the surface of the strip, and thus from the feeding plane. Instead, in the resting position, distal from the strip feeding plane X, the electromagnetic stabilizer device 2 is, for example, at a distance of 100 to 250 mm from the surface of the strip, and thus from the feeding plane.

In an advantageous embodiment (FIG. 6), the central stretch 6' of each second support beam 6 is arranged in proximity of the central stretch 3' of the corresponding first support beam 3, in a position above, and preferably at least partially innermost, or completely innermost, with respect to said central stretch 3' so that the respective electromagnetic stabilizer device 2 housed in the recess of the corresponding support beam 6 can be close to the corresponding air knife 1 underneath.

Referring for example to FIG. 6, the second support beams 6 are arranged only partially above the first support beams 3. In particular, the central stretch 6' of each second support beam 6 is arranged above the central stretch 3' of the corresponding first support beam 3.

Each electromagnetic stabilizer device 2 can extend below the recess of the respective second support beam 6, preferably underneath the central stretch 3' of the corresponding first support beam 3, so that the distance between the electromagnetic stabilizer device 2 and the underlying air knife 1 is comprised between 200 and 1500 mm, preferably between 200 and 1000 mm.

Preferably, each central stretch 6' is arranged at a lower height than that of an upper edge of the first ends 3" and second ends 3'" of the first support beams 3.

Figure 5:
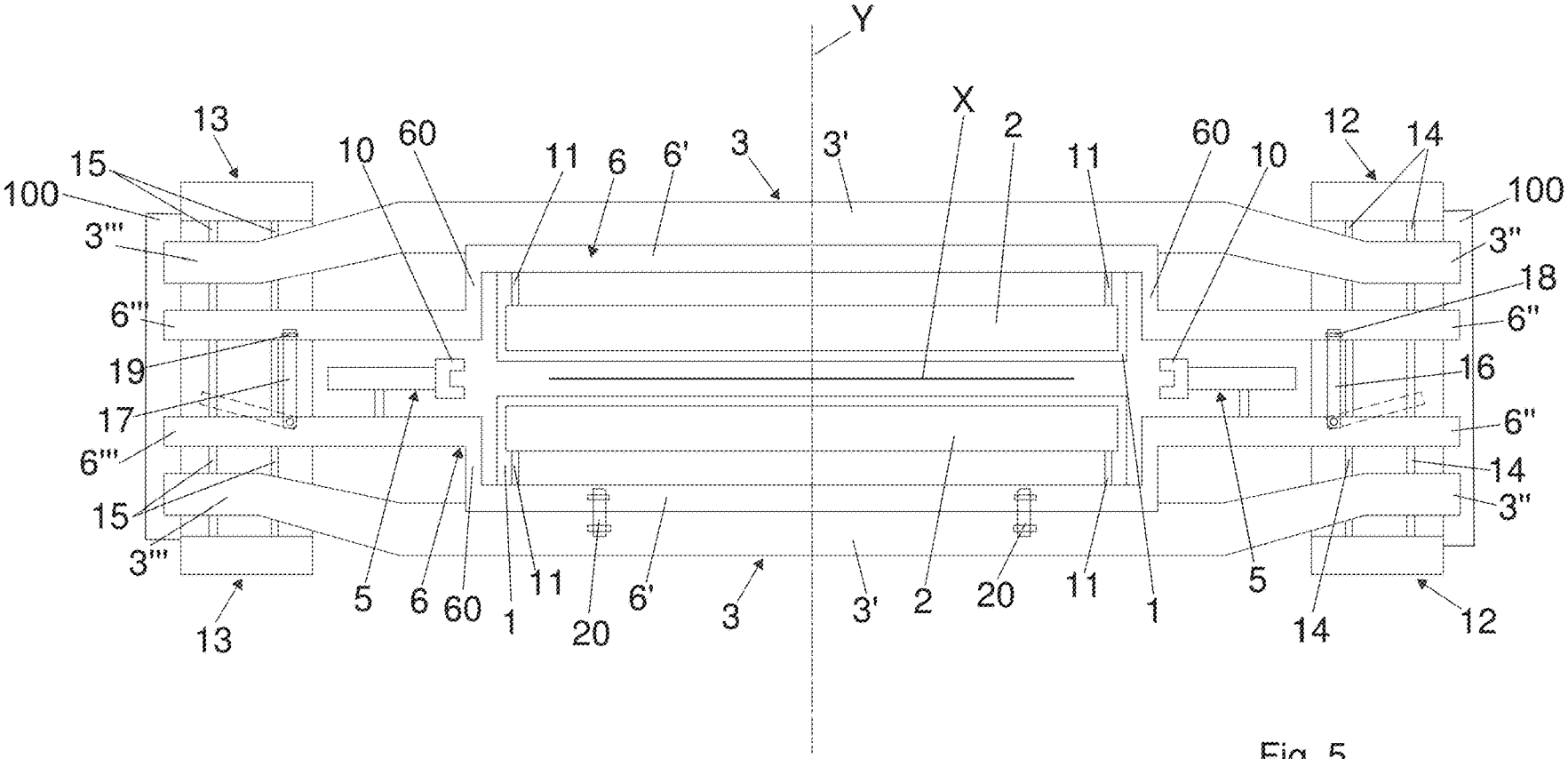
FIG. 5 is a top view of a stabilization apparatus according to the invention.

In a further embodiment of the apparatus of the invention, both the first ends 3" and the second ends 3'" of the first support beams 3 rest on respective sliding guides 14, 15, which are perpendicular to the theoretical feeding plane X and provided on the first side structure 12 and the second side structure 13, respectively, so that the first support beams 3 can slide on said sliding guides 14, 15 to adjust the distance between the two air knives 1 (FIG. 5).

This horizontal movement of the first support beams 3 can be powered by separate stepper motors. The transmission can comprise a precision ball screw and linear guides 14, 15.

Such a horizontal movement of the support beams 3 can be between −20 mm, if they approach the feeding plane of the strip, and +100 mm, if they move away from said feeding plane, with respect to their initial reference position.

The strip feed plane (passline) can move horizontally, along the plane Y, by ±25 mm.

The first support beams 3 can be adjusted parallel or inclined with respect to a horizontal plane.

A horizontal fast-open feature of the first support beams 3, and thus of the air knives 1, can be provided upon the passage of the weld seams present in the strip rising from the molten metal bath. In this case, the horizontal movement speed is, for example, approximately 2-4 seconds per 100 mm of stroke.

At least one linear transducer can be provided for all motors, both for the motors of vertical movement and for the motors of horizontal movement.

If the passline of the strip is displaced with respect to the design position, i.e. with respect to the theoretical feeding plane, with the consequent movement of the air knives 1 along said sliding guides 14, 15, in order to maintain symmetry of the air knives with respect to the real feeding plane, offset with respect to said theoretical feeding plane X, then also the second support beams 6 are self-adjusting by means of an appropriate mechanical system to maintain said second support beams 6 in a specular position, i.e. symmetrical, with respect to said real feeding plane.

This mechanical system, e.g. a system of screws and/or levers, preferably placed inside the side structures 12, 13 optionally below the plane containing the sliding guides 14, 15, also allows the self-adjustment of the position of the baffles 7 in the variant in which the baffle system 4 of the air jets, coming from the air knives 1, is arranged between the second support beams 6 and fixed to one of said second support beams 6.

A further variant of the invention provides that at least one stiffening crosspiece 16, 17 is provided at both the first ends 6" and the second ends 6'" of the second support beams 6 (FIG. 5). Each stiffening crosspiece 16, 17 has a first end thereof rotatably constrained to one of the second support beams 6 and a second end thereof adapted to engage with a locking device 18, 19 provided on the other of the second support beams 6. This makes it possible to create a sort of frame which increases the flexural rigidity of the stabilization group and, preferably, also of the baffle system of the air jets.

Connecting devices 20 can also be provided to connect each of the first support beams 3 to the second support beam 6 proximal thereto if both the pair of first support beams 3 and the pair of second support beams 6 need to be lifted together by means of a crane.

In all embodiments of the apparatus of the invention, the air knives 1, just above the tank containing the molten metal bath 21, adjust the thickness of the molten metal coating on the strip faces by means of pressurized air jets to reach a uniform coating of the desired thickness.

Each air knife can produce a uniform jet of air across the width of the nozzle 22 (FIG. 4) by first passing air through a series of internal, mutually partially separated chambers, with successively smaller flow passages approaching the nozzle 22. The passage through each restriction forces the air pressure to become more uniform. At the outlet of the lips of the nozzle 22, the pressure profile is uniform to ±1.5% or less across the entire width.

By way of example:

- the maximum pressure required at each air knife inlet is approximately 850-950 mbar;
- the maximum air flow rate required for each air knife is approximately 60-65 $Nm^3$/min at 20° C.;
- the flow rate of the blower feeding the air knives is between about 65 and 145 $m^3$/min at 20° C.;
- the installed power per blower is about 300 kW.

A manual mechanism for adjusting the angle of the nozzle 22, with respect to the theoretical feeding plane X, and/or manual mechanisms for adjusting the gap between the nozzle lips can be provided.

Preferably, the width of the opening of the nozzle 22, measured parallel to the plane X, is between 1400-2000 mm, e.g. 1900 mm. The gap between the nozzle lips can be a maximum of 2.5 mm, e.g. from 1.0 mm (in the middle) to 1.3 mm (at the ends). The angle adjustment range of the nozzle 22 is about 10°, e.g. from +3° to −7° with respect to the horizontal.

A pneumatically operated automatic nozzle cleaning device 22 can be provided.

In all embodiments of the apparatus of the invention, the electromagnetic stabilizing devices 2 make it possible to reduce strip vibrations, to flatten the strip (shape correction action) and establish a constant passline between the air knives 1. This results in a more homogeneous zinc coating on the strip, reduced zinc coating and improved product quality. Furthermore, this increases productivity, unless there are limitations due to other equipment, such as submerged bearings for stabilizing sink rolls or annealing furnace.

Preferably, each electromagnetic stabilizer device 2 comprises a housing positioned above the body of the underneath air knife body 1, as close as possible to the nozzle 22 to maximize the magnetic stabilization effect. Said housing can internally enclose a plurality of magnetic actuators and eddy current sensors; the electronics of the eddy current sensors; and mechanical motion units for a sliding on the guides 11. The magnetic actuators and the eddy current sensors of each device 2 operate in pairs with the corresponding and opposite magnetic actuators and eddy current sensors of the other device 2.

In particular, a motorized movement mechanism in each housing can allow an independent adjustment of the position of each housing perpendicularly with respect to the air knife body and to the strip.

The operating distance of each housing from the strip is, for example, about 20 mm and can be retracted to a distance of, for example, about 70 mm from the strip. The maximum speed of the horizontal movement of the stabilizer devices 2 is about 50 mm/s.

The maximum offset of the strip, along the horizontal, from the theoretical feeding plane is ±25 mm, while the correction of its inclination is has a maximum value of 1°.

The strip rising from the molten metal bath passes between the two air-cooled housings which house the magnetic actuators and the eddy current sensors. The housings are specially designed to protect the device from the harsh environment, from the thermal radiation coming from the strip, and from the tank containing the molten metal bath.

Furthermore, the electromagnetic configuration of the stabilizer devices 2 is defined to impose a spatially continuous magnetic force along the width of the strip, as opposed to a spot-like distribution, in order to provide the best planarity control.

The invention claimed is:

1. A stabilization apparatus for stabilizing a metal strip rising from a molten metal bath along a theoretical feeding plane, the apparatus comprising at least one pair of air knives, a first air knife of which is arranged at a first side and a second air knife is arranged at a second side, opposite to the first side, with respect to said theoretical feeding plane;

at least one pair of electromagnetic stabilizer devices, a first electromagnetic stabilizer device of which is arranged at said first side and a second electromagnetic stabilizer device is arranged at said second side;

a pair of first support beams, each first support beam supporting a respective air knife;

a pair of second support beams, each second support beam supporting a respective electromagnetic stabilizer device; wherein the pair of second support beams is separate from and not in contact with the pair of first support beams, and wherein the first support beams are distal from the theoretical feeding plane, while the second support beams are proximal to said theoretical feeding plane so that said second support beams are arranged, with reference to the theoretical feeding plane, in an, at least partially, innermost position with respect to the pair of first support beams;

wherein each of the first support beams and each of the second support beams have a respective first end resting on a first side structure, and each of the first support beams and each of the second support beams have a respective second end resting on a second side structure;

wherein the first support beams have a respective central stretch supporting the respective air knife, said central stretch of the first support beams being outermost of the corresponding first ends and second ends of the first support beams, with reference to the theoretical feeding plane, and being lowered with respect to said corresponding first ends and second ends;

wherein the second support beams have a respective central stretch of the second support beams which is outermost of the corresponding first ends and second ends of the second support beams, with reference to the theoretical feeding plane, and which, from a proximal side of the central stretch of each of the second support beams with respect to said theoretical feeding plane, delimits a recess of the corresponding second support beam which accommodates the respective electromagnetic stabilizer device;

and wherein the central stretches of the first support beams are arranged at a distance from the theoretical feeding plane so as to allow an accommodation of the electromagnetic stabilizer devices in a zone between said two central stretches of the first support beams.

2. The apparatus according to claim 1, wherein the two first support beams of said at least one pair of first support beams are arranged at said first side and said second side, respectively, and are mutually distinct; and wherein the two second support beams of said at least one pair of second support beams are also arranged at said first side and said second side, respectively, and are mutually distinct.

3. The apparatus according to claim 1, wherein a baffle system for air jets, coming from said air knives, is arranged between the second support beams, is fixed to at least one of said second support beams and comprises at least one pair of baffles, each baffle of said at least one pair of baffles being placed between the air knives at a respective end of at least one of the air knives.

4. The apparatus according to claim 3, wherein said baffle system comprises two supports, each support being arranged at a respective side of a plane perpendicular to said theoretical feeding plane, each support having a lower arm, provided with a respective baffle, and an upper arm provided with a detection device for detecting an edge of the strip.

5. The apparatus according to claim 1, wherein each electromagnetic stabilizer device is arranged at least partially within a recess of the respective second support beam provided with sliding guides for the electromagnetic stabilizer device to slide along a direction perpendicular to said theoretical feeding plane, from a working position to a resting position, or vice versa.

6. The apparatus according to claim 1, wherein said first side structure and said second side structure have respective vertical movement means to either lift or lower each of the first support beams, each of the second support beams, or all of the first and second support beams together.

7. The apparatus according to claim 1, wherein the central stretch of each second support beam is arranged at the central stretch of the corresponding first support beam.

8. The apparatus according to claim 1, wherein each electromagnetic stabilizer device extends below the recess of the respective second support beam.

9. The apparatus according to claim 1, wherein both the first ends and the second ends of the first support beams rest on respective sliding guides, which are perpendicular to said theoretical feeding plane and provided on the first side structure and the second side structure, respectively, so that the first support beams can slide to adjust the distance between the two air knives.

10. The apparatus according to claim 9, wherein a mechanical system is provided to maintain the second support beams in a symmetric position with respect to a real feeding plane, which is offset with respect to said theoretical feeding plane.

11. The apparatus according to claim 1, wherein at least one stiffening crosspiece is provided at both the first ends and the second ends of the second support beams, each stiffening crosspiece having a first end thereof hinged to one of the second support beams and a second end thereof adapted to engage a locking device provided on the other of the second support beams.

12. The apparatus according to claim 1, wherein connecting devices are provided to connect each of the first support beams to the second support beam proximal thereto when both the pair of first support beams and the pair of second support beams are lifted by a crane.

13. A plant for coating a metal strip with a molten metal layer, comprising the stabilization apparatus according to claim 1 arranged above a tank adapted to contain the molten metal bath.

14. The apparatus according to claim 1, wherein said first end rests on the first side structure independently from the other first ends and said second end rests on the second side structure independently from the other second ends.

15. The apparatus according to claim 6, wherein the vertical movement means are mutually synchronized.

16. The apparatus according to claim 7, wherein the central stretch of each second support beam is arranged in an at least partially innermost position with respect to said central stretch of the corresponding first support beam.

17. The apparatus according to claim 7, wherein said central stretch of each second support beam is arranged at a lower height than that of an upper edge of the first ends and second ends of the pair of first support beams.

18. The apparatus according to claim 8, wherein each electromagnetic stabilizer device extends underneath the central stretch of the corresponding first support beam.

19. A stabilization apparatus for stabilizing a metal strip rising from a molten metal bath along a theoretical feeding plane, the apparatus comprising at least one pair of air knives, a first air knife of which is arranged at a first side and a second air knife is arranged at a second side, opposite to the first side, with respect to said theoretical feeding plane;

at least one pair of electromagnetic stabilizer devices, a first electromagnetic stabilizer device of which is arranged at said first side and a second electromagnetic stabilizer device is arranged at said second side;

a pair of first support beams, each first support beam supporting a respective air knife;

a pair of second support beams, each second support beam supporting a respective electromagnetic stabilizer device;

wherein the pair of second support beams is separate from and not in contact with the pair of first support beams, and wherein the first support beams are distal from the theoretical feeding plane, while the second support beams are proximal to said theoretical feeding plane so that said second support beams are arranged, with reference to the theoretical feeding plane, in an, at least partially, innermost position with respect to the pair of first support beams;

wherein at least one stiffening crosspiece is provided at both first ends and second ends of the second support beams, each stiffening crosspiece having a first end thereof hinged to one of the second support beams and a second end thereof adapted to engage a locking device provided on the other of the second support beams.

* * * * *